US005447549A

United States Patent [19]

Yoshimura

[11] Patent Number: 5,447,549

[45] Date of Patent: Sep. 5, 1995

[54] HARD ALLOY

[75] Inventor: Hironori Yoshimura, Ibaraki, Japan

[73] Assignee: Mitsubishi Materials Corporation, Tokyo, Japan

[21] Appl. No.: 18,397

[22] Filed: Feb. 17, 1993

[30] Foreign Application Priority Data

Feb. 20, 1992 [JP] Japan ..... 4-070395
Feb. 20, 1992 [JP] Japan ..... 4-070396

[51] Int. Cl.[6] ..... C22C 29/00; C22C 29/02; C22C 29/12; C22C 29/16

[52] U.S. Cl. ..... 75/238; 75/228; 75/245; 75/246; 75/248; 75/249; 75/950

[58] Field of Search ..... 75/228, 238, 245, 246, 75/248, 249, 950

[56] References Cited

U.S. PATENT DOCUMENTS

| | | | |
|---|---|---|---|
| 2,121,448 | 6/1938 | Ritzau | 75/136 |
| 4,097,275 | 6/1978 | Horvath | 75/203 |
| 4,935,057 | 6/1990 | Yoshimura et al. | 75/238 |
| 4,944,800 | 7/1990 | Kolaska et al. | 75/238 |
| 4,950,328 | 8/1990 | Odani et al. | 75/240 |
| 4,956,012 | 9/1990 | Jacobs | 75/236 |
| 5,041,261 | 8/1991 | Buljan et al. | 419/11 |
| 5,071,473 | 12/1991 | Reeder et al. | 75/240 |
| 5,223,020 | 6/1993 | Kolaska | 75/238 |
| 5,330,553 | 7/1994 | Weinl et al. | 75/236 |
| 5,334,561 | 8/1994 | Matsui et al. | 501/87 |

FOREIGN PATENT DOCUMENTS

| | | |
|---|---|---|
| 0246211 | 11/1987 | European Pat. Off. . |
| 0247985 | 12/1987 | European Pat. Off. . |
| 2209448 | 8/1990 | Japan . |

OTHER PUBLICATIONS

Derwent Publications Ltd., AN 92-231864, JP-A-4 159 081, Jun. 2, 1992.
Derwent Publications Ltd., AN 90-271174, JP-A-2 190 404, Jul. 26, 1990.
Derwent Publications Ltd., AN 91-204809, JP-A-3 130 349, Jun. 4, 1991.

*Primary Examiner*—Donald P. Walsh
*Assistant Examiner*—Daniel Jenkins
*Attorney, Agent, or Firm*—Oblon, Spivak, McClelland, Maier, & Neustadt

[57] ABSTRACT

A hard alloy suitable for use in cutting tools, which exhibits excellent wear and fracture resistance, is disclosed. The hard alloy includes a hard dispersed phase and a binder metal phase, and the binder metal phase is constructed so that compressive stress, preferably of no less than 98 MPa (10 kgf/mm$^2$), is retained therein. The hard alloy may be a cermet which includes a hard dispersed phase of at least one compound of titanium carbonitride and composite carbonitrides of titanium with at least one element of tantalum, tungsten, molybdenum, niobium, vanadium, chromium, zirconium or hafnium, and a binder metal phase of one or more of cobalt, nickel, iron and aluminum. The hard alloy may also be a cemented carbide in which the hard dispersed phase contains tungsten carbide and, optionally, one or more components of carbide, nitride and carbonitride which contains at least one of titanium, tantalum, molybdenum, niobium, vanadium or chromium, and in which the binder metal phase contains one or more metals of cobalt, nickel, iron and aluminum.

11 Claims, No Drawings

HARD ALLOY

BACKGROUND ART

This application claims the priorities of Japanese Patent Applications No. 4-70395 and No. 4-70396 both filed Feb. 20, 1992, which are incorporated herein by reference.

The present invention relates to a hard alloy, such as cermet or cemented carbide, which exhibits excellent wear resistance and fracture resistance when used as cutting tools.

A known cermet which includes: a hard dispersed phase composed of carbonitride of titanium (Ti) or composite carbonitride of titanium and at lease one element of tantalum (Ta), tungsten (W), molybdenum (Mo), niobium (NBc), vanadium (V), chromium (Cr), zirconium (Zr) or hafnium (Hf); and a binder metal phase composed of at lease one metal of cobalt (Co), nickel (Ni), iron (Fe) or aluminum (Al) has hitherto been used in cutting tools for finishing cuts on steel or the like, whereas a known cemented carbide which includes: a hard dispersed phase composed of tungsten carbide (Wc) and optionally at least one compound of carbide, nitride or carbonitride which contains at least one element of titanium, tantalum, molybdenum, niobium, vanadium or chromium; and a binder metal phase composed of at least one metal of cobalt, nickel, iron or aluminum has hitherto been used in cutting tools for roughing cuts on steel, cast iron or the like.

Inasmuch as the aforesaid conventional hard alloy is a composite material comprised of the hard dispersed phase and the binder metal phase, compressive stress is intrinsically exerted on the hard dispersed phase while tensile stress is exerted on the binder metal phase upon the completion of sintering.

More specifically, cobalt, nickel, iron and aluminum, which serve as metals for defining the binder metal phase of the aforesaid hard alloy, have coefficients of thermal expansion of $12.36\times10^{-6}$/°C., $13.30\times10^{-6}$/°C., $1150\times10^{-6}$/°C. And $23.13\times10^{-6}$/°C., respectively. In contrast, since titanium carbide (TiC) and titanium nitride (TiN) have coefficients of thermal expansion of $7.42\times10^{-6}$/°C. and $9.35\times10^{-6}$/°C., respectively, the coefficient of thermal expansion of titanium carbonitride (TiCN) defining the hard dispersed phase of the cermet, should have a value between them. Furthermore, with respect to the constituents defining the hard dispersed phase of the cemented carbide, the coefficient of thermal expansion of tungsten carbide is $5.2\times10^{-6}$/°C. as measured in the a-axis direction, and $7.3\times10^{-6}$/°C. as measured in the c-axis direction. Also, the coefficients of thermal expansion of tantalum carbide (TaC) and niobium carbide (NbC) are $6.29\times10^{-6}$/°C. and $6.65\times10^{-6}$/°C., respectively. Thus, in both cermet and cemented carbide, the coefficient of thermal expansion for the binder metal phase is greater than that for the hard dispersed phase, and hence the shrinkage of the binder metal phase, upon cooling after the sintering operation, becomes greater than that of the hard dispersed phase. Therefore, the binder metal phase shrinks in such a way as to encapsulate the hard dispersed phase therein, so that the hard dispersed phase undergoes compressive stress while the binder metal phase undergoes tensile stress. Thus, the compressive stress is retained in the hard dispersed phase of the resulting alloy, whereas the tensile stress is retained in the binder metal phase thereof.

In the case where the conventional hard alloy of the aforesaid construction is directly used to manufacture cutting tools, the cutting edges of the resulting tools are not only susceptible to chipping against the great impact to be exerted on the surfaces, but are also insufficient in wear resistance, thereby resulting in a very short tool life. In order to circumvent these problems, various specially developed sintering techniques have hitherto been applied to enhance the fracture resistance, or a hard coating has been formed on the surface of the tool to improve the wear resistance. However, since these measures require an increased manufacturing cost, the resulting cutting tools have become expensive.

SUMMARY OF THE INVENTION

It is therefore the object of the present invention to provide a hard alloy which, when used as a cutting tool, exhibits superior wear resistance and fracture resistance compared with conventional hard alloys, and which can be easily manufactured at a reduced cost.

According to the present invention, there is provided a hard alloy comprising a hard dispersed phase and a binder metal phase, with the binder metal phase constructed so that compressive stress is retained therein.

In the foregoing hard alloy, since the compressive stress is retained in the binder metal phase, the hard alloy exhibits excellent wear resistance and fracture resistance. It is preferable that the compressive stress retained in the binder metal phase be no less than 98 MPa (10 kgf/mm$^2$).

Furthermore, the hard alloy may have arbitrary compositions, and hence it could be comprised of cermet or cemented carbide. A typical cermet to be used for the purpose of the invention may comprise: a hard dispersed phase which consists essentially of at least one compound selected from the group consisting of titanium carbonitride and composite titanium carbonitride which further contains at least one element selected from the group consisting of tantalum, tungsten, molybdenum, niobium, vanadium, chromium, zirconium and hafnium; and a binder metal phase which consists essentially of at least one metal selected from the group consisting of cobalt, nickel, iron and aluminum. Similarly, a typical cemented carbide for cutting tools may have: a hard dispersed phase which consists essentially of tungsten carbide and, optionally, at least one compound selected from the group consisting of carbide, nitride and carbonitride which contains at least one element of titanium, tantalum, molybdenum, niobium, vanadium or chromium; and a binder metal phase which consists essentially of at least one metal selected from the group consisting of cobalt, nickel, iron and aluminum.

DETAILED DESCRIPTION OF THE INVENTION

While observing stresses exerted on the hard dispersed phase and the binder metal phase, the inventors have made an extensive study to develop a hard alloy which not only has superior wear and fracture resistances compared with conventional hard alloys, but also can be manufactured at a reduced cost. As a result, they have come to realize that when the hard alloy is constructed so that compressive stress is retained in the binder metal phase, the resulting alloy unexpectedly exhibits excellent wear and fracture resistance.

Thus, the hard alloy, in accordance with the present invention, is characterized in that compressive stress, preferably of no less than 98 MPa (10 kgf/mm$^2$), is retained in the binder metal phase. With this construction, the hard alloy exhibits substantially enhanced wear resistance and fracture resistance compared with conventional hard alloys.

In order to retain the compressive stress in the binder metal phase, several methods are applicable. For example, a mechanical method of treatment, involving sand blasting or shot peening against the surface of the sintered alloy, or a physical method of treatment, involving ion etching on the surface thereof, can be applied. Thus, neither special sintering techniques nor hard coating need be applied to enhance wear and fracture resistance, and consequently a substantial reduction of the manufacturing cost can be achieved.

The hard alloy of the invention may have arbitrary compositions, and can be composed of cermet or cemented carbide. A typical cermet to be used for the purpose of the invention may comprise: a hard dispersed phase which consists essentially of at least one compound selected from the group consisting of titanium carbonitride and composite titanium carbonitride which further contains at least one element selected from the group consisting of tantalum, tungsten, molybdenum, niobium, vanadium, chromium, zirconium and hafnium; and a binder metal phase which consists essentially of at least one metal selected from the group consisting of cobalt, nickel, iron and aluminum. Such cermet may have any composition, but typically has 5 to 30%, by weight, of the binder metal phase, with the balanced hard dispersed phase composed of titanium carbonitride. When composite titanium carbonitrides are contained as the hard dispersed phase constituents, the total content of these constituents should be preferably between 10 and 60%, by weight, with respect to the total amount of the cermet. Similarly, a typical cemented carbide for cutting tools may comprise: a hard dispersed phase which consists essentially of tungsten carbide and, optionally, at least one compound selected from the group consisting of carbide, nitride and carbonitride which contains at least one element of titanium, tantalum, molybdenum, niobium, vanadium or chromium; and a binder metal phase which consists essentially of at least one metal selected from the group consisting of cobalt, nickel, iron and aluminum. Such cemented carbide may have any composition, but typically has 3 to 30%, by weight, of the binder metal phase and balance hard dispersed phase of tungsten carbide. When carbide, nitride and/or carbonitride are further added to the hard dispersed phase, the total content of these constituents should be preferably between 0.1 to 30%, by weight, with respect to the total amount of the cemented carbide.

The present invention will now be described in detail with reference to the following examples.

EXAMPLE 1

Powders were blended and mixed into a composition of TiCN-15% WC-10% TaC-10% $Mo_2C$-10% Co-5% Ni (% denotes % by weight), and pressed into green compacts, which were then sintered under ordinary conditions to produce TiCN-based sintered cermets having a shape of a cutting insert in conformity with ISO, TNMG 160412.

Thereafter, a large number of steel balls, 300 micrometers in average diameter, were blasted against the sintered cermets under the conditions set forth in Table 1. The cermets thus obtained, were tested for residual stresses in both the hard dispersed phase and the binder metal phase of the surface portions, by means of an X-ray stress-measuring device. The cermets in which compressive stress was retained in the binder metal phase are indicated as cermets 1 to 8 of the invention, while the other cermets in which the residual stress in the binder phase is tensile stress, are indicated as comparative cermets 1 to 4.

Furthermore, for the purpose of comparison, a TiCN-based sintered cermet which was obtained by the same procedures, without treatment with the steel balls, was used as a prior art cermet. Its residual stress was also measured and stated in Table 1.

In order to evaluate the wear resistance, the cermets 1 to 8 of the invention, the comparative cermets 1 to 4, and the prior art cermet obtained as described above, were subjected to a continuous cutting test under the following conditions:

Workpiece: round bar of steel (JIS.SCM 440)
Cutting speed: 200 m/minute
Feed rate: 0.2 mm/revolution
Depth of cut: 1.0 mm
Cutting time: 30 minutes In this test, the flank wear width was measured.

Similarly, in order to evaluate the fracture resistance, all of the above cermets were subjected to an interrupted cutting test under the following conditions, and then the number of the cutting inserts fractured per ten, was determined.

Workpiece: round bar of steel (JIS.SCM 440)
Cutting speed: 200 m/minute
Feed rate: 0.26 mm/revolution
Depth of cut: 1.0 mm
Cutting time: 2 minutes The results of the above two tests are stated in Table 1.

As clearly seen from the results, the cermets 1 to 8 of the invention, in which the compressive stress is retained in the binder metal phases, exhibit greater wear resistance and fracture resistance than the comparative cermets 1 to 4 and the prior art cermet in which the residual stress in the binder metal phase is tensile stress.

EXAMPLE 2

Powders were blended and mixed into a composition of WC-1% TaC—6% Co (% denotes % by weight), and pressed into green compacts, which were then sintered under usual conditions to produce WC-based cemented carbides having a configuration of a cutting insert in conformity with ISO, TNMG 160412.

Thereafter, a large number of steel balls, 300 micrometers in average diameter, were blasted against the sintered carbides under the conditions set forth in Table 2. The cemented carbides thus obtained were tested for residual stresses in both the hard dispersed phase and the binder metal phase of the surface portions, by means of the X-ray stress-measuring device, and the cemented carbides in which compressive stress was retained in the binder phase, are indicated as cemented carbides 1 to 6 of the invention, while the other cemented carbides in which the residual stress in the binder phase is tensile stress are indicated as comparative cemented carbides 1 to 3.

Furthermore, for the purpose of comparison, a WC based cemented carbide which was obtained by the same procedures, without treatment with the steel balls, was used as a prior art cemented carbide 1. Its residual stress was also measured and stated in Table 2.

In order to evaluate the wear resistance, the cemented carbides 1 to 6 of the invention, the comparative cemented carbides 1 to 3, and the prior art cemented carbide 1 thus obtained, were subjected to a continuous cutting test under the following conditions:

Workpiece: round bar of cast iron (JIS.FC 30)
Cutting speed: 80 m/minute
Feed rate: 0.3 mm/revolution
Depth of cut: 1.5 mm
Cutting time: 20 minutes In this test, the flank wear width was measured.

Similarly, in order to evaluate the fracture resistance, all of the above cemented carbides were subjected to an interrupted cutting test under the following conditions, and the number of the cutting inserts fractured per ten was determined.

Workpiece: round bar of cast iron (JIS.FC 30) with four grooves
Cutting speed: 100 m/minute
Feed rate: 0.3 mm/revolution
Depth of cut: 2.0 mm
Cutting time: 5 minutes The results of the above two tests are stated in Table 2.

As clearly seen from the results, the cemented carbides 1 to 6 of the invention, in which the compressive stress is retained in the binder metal phases, exhibit greater wear resistance and fracture resistance than the comparative cemented carbides 1 to 3 and the prior art cemented carbide in which the residual stress in the binder metal phase is tensile stress.

EXAMPLE 3

Powders were blended and mixed into a composition of WC—8% TiC—10% TaC—1% NbC—9% Co (% denotes % by weight), and pressed into green compacts, which were then sintered under ordinary conditions to produce WC-based cemented carbides having a configuration of a cutting insert in conformity with ISO. SNMG 432.

Thereafter, a large number of steel balls, 250 micrometers in average diameter, were blasted against the cemented carbides under the conditions set forth in Table 3. The cemented carbides thus obtained were tested for residual stresses in both the hard dispersed phase and the binder metal phase of the surface portions, by means of the X-ray stress-measuring device, and the cemented carbides in which compressive stress was retained in the binder phase, are indicated as cemented carbides 7 to 11 of the invention, while the other cemented carbides in which the residual stress in the binder phase is tensile stress are indicated as comparative cemented carbides 4 to 6.

Furthermore, for the purpose of comparison, a WC-based cemented carbide which was obtained by the same procedures, without treatment with the steel balls, was used as a prior art cemented carbide 2. Its residual stress was also measured and stated in Table 3.

In order to evaluate the wear resistance, the cemented carbides 7 to 11 of the invention, the comparative cemented carbides 4 to 6, and the prior art cemented carbide 2 thus obtained, were subjected to a continuous cutting test under the following conditions:

Workpiece: round bar of alloy steel (JIS.SCM 440)
Cutting speed: 120 m/minute
Feed rate: 0.3 mm/revolution
Depth of cut: 1.5 mm
Cutting time: 20 minutes In this test, the flank wear width was measured, and the results are stated in Table 3.

Similarly, in order to evaluate the fracture resistance, all of the above cemented carbides were subjected to an interrupted cutting test under the following conditions, and the number of the cutting inserts fractured per ten was determined.

Workpiece: round bar of alloy steel (JIS.SCM 440) with four grooves
Cutting speed: 120 m/minute
Feed rate: 0.3 mm/revolution
Depth of cut: 2.0 mm
Cutting time: 2 minutes The results of the above test are also stated in Table 3.

As clearly seen from the results, the cemented carbides 7 to 11 of the invention, in which the compressive stress is retained in the binder metal phases, exhibit greater wear resistance and fracture resistance than the comparative cemented carbides 4 to 6 and the prior art cemented carbide 2 in which the residual stress retained in the binder metal phase is tensile stress.

TABLE 1

| | Collision conditions | | Residual stress* ($kgf/mm^2$) | | Continuous cutting test Flank wear width | Interruped cutting test Fractured inserts |
|---|---|---|---|---|---|---|
| | Collision velocity (m/sec) | Collision time (min) | Hard phase | Binder phase | (mm) | Tested inserts |
| Cermets of the invention | | | | | | |
| 1 | 60 | 1.5 | −40 | −8 | 0.17 | 4/10 |
| 2 | 70 | 1.5 | −43 | −12 | 0.15 | 2/10 |
| 3 | 80 | 1.5 | −45 | −16 | 0.13 | 0/10 |
| 4 | 90 | 1.5 | −48 | −20 | 0.12 | 0/10 |
| 5 | 100 | 3.0 | −60 | −35 | 0.12 | 0/10 |
| 6 | 80 | 1.0 | −44 | −10 | 0.15 | 1/10 |
| 7 | 80 | 2.0 | −46 | −18 | 0.14 | 0/10 |
| 8 | 80 | 3.0 | −48 | −20 | 0.13 | 0/10 |
| Comparative cermets | | | | | | |
| 1 | 40 | 1.0 | −30 | +16 | 0.36 | 9/10 |
| 2 | 40 | 2.0 | −32 | +12 | 0.33 | 8/10 |
| 3 | 80 | 0.1 | −30 | +15 | 0.35 | 9/10 |
| 4 | 80 | 0.3 | −32 | +8 | 0.30 | 8/10 |
| Prior art | — | — | −15 | +20 | 0.39 | 10/10 |

TABLE 1-continued

| | Collision conditions | | | | | |
|---|---|---|---|---|---|---|
| | Collision velocity (m/sec) | Collision time (min) | Residual stress* (kgf/mm²) Hard phase | Residual stress* (kgf/mm²) Binder phase | Continuous cutting test Flank wear width (mm) | Interruped cutting test Fractured inserts Tested inserts |
| cermet | | | | | | |

*(+) denotes tensile stress while (−) denotes compressive stress.

TABLE 2

| | Collision conditions | | | | | |
|---|---|---|---|---|---|---|
| | Collision velocity (m/sec) | Collision time (min) | Residual stress* (kgf/mm²) Hard phase | Residual stress* (kgf/mm²) Binder phase | Continuous cutting test Flank wear width (mm) | Interruped cutting test Fractured inserts Tested inserts |
| Cemented carbides of the invention | | | | | | |
| 1 | 70 | 2.0 | −58 | −10 | 0.19 | 3/10 |
| 2 | 80 | 1.5 | −57 | −13 | 0.17 | 2/10 |
| 3 | 90 | 1.5 | −63 | −16 | 0.15 | 1/10 |
| 4 | 100 | 1.5 | −66 | −19 | 0.14 | 1/10 |
| 5 | 90 | 2.0 | −65 | −18 | 0.14 | 0/10 |
| 6 | 70 | 1.5 | −53 | −7 | 0.21 | 4/10 |
| Comparative cemented carbides | | | | | | |
| 1 | 50 | 1.5 | −41 | +25 | 0.37 | 9/10 |
| 2 | 60 | 1.0 | −42 | +18 | 0.33 | 8/10 |
| 3 | 90 | 0.1 | −41 | +20 | 0.36 | 9/10 |
| Prior art cemented carbide | | | | | | |
| 1 | — | — | −20 | +29 | 0.45 | 10/10 |

*(+) denotes tensile stress while (−) denotes compressive stress.

TABLE 3

| | Collision conditions | | | | | |
|---|---|---|---|---|---|---|
| | Collision velocity (m/sec) | Collision time (min) | Residual stress* (kgf/mm²) Hard phase | Residual stress* (kgf/mm²) Binder phase | Continuous cutting test Flank wear width (mm) | Interruped cutting test Fractured inserts Tested inserts |
| Cemented carbides of the invention | | | | | | |
| 7 | 90 | 1.5 | −59 | −15 | 0.18 | 2/10 |
| 8 | 90 | 2.0 | −62 | −17 | 0.16 | 1/10 |
| 9 | 90 | 2.5 | −65 | −19 | 0.15 | 0/10 |
| 10 | 100 | 1.5 | −63 | −18 | 0.16 | 1/10 |
| 11 | 100 | 2.0 | −67 | −20 | 0.14 | 0/10 |
| Comparative cemented carbides | | | | | | |
| 4 | 50 | 1.5 | −39 | +21 | 0.36 | 8/10 |
| 5 | 60 | 1.5 | −40 | +19 | 0.32 | 8/10 |
| 6 | 90 | 0.1 | −39 | +21 | 0.37 | 9/10 |
| Prior art cemented carbide | | | | | | |
| 2 | — | — | −17 | +25 | 0.43 | 10/10 |

*(+) denotes tensile stress while (−) denotes compressive stress.

What is claimed is:

1. A hard alloy comprising a hard dispersed phase and a binder metal phase, with said binder metal phase constructed so that compressive stress is retained therein, and wherein said compressive stress retained in said binder metal phase is no less than 10 kgf/mm².

2. A hard alloy as recited in claim 1, wherein said hard dispersed phase consists essentially of at least one compound selected from the group consisting of titanium carbonitride and composite titanium carbonitride which contains at least one element selected from the group consisting of tantalum, tungsten, molybdenum, niobium, vanadium, chromium, zirconium and hafnium, and wherein said binder metal phase consists essentially of at least one metal selected from the group consisting of cobalt, nickel, iron and aluminum.

3. A hard alloy as recited in claim 1, wherein said hard dispersed phase consists essentially of tungsten carbide and, optionally, at least one compound selected from the group consisting of carbide, nitride and carbonitride which contains at least one element of titanium, tantalum, molybdenum, niobium, vanadium or chromium, and wherein said binder metal phase consists essentially of at least one metal selected from the group consisting of cobalt, nickel, iron and aluminum.

4. A hard alloy as recited in claim 1, wherein said hard alloy comprises no more than 30% by weight of said binder metal phase.

5. A hard alloy as recited in claim 2, wherein said hard alloy comprises 5–30% by weight of said binder metal phase.

6. A hard alloy as recited in claim 2, wherein said hard alloy comprises 10–60% by weight of said hard dispersed phase.

7. A hard alloy as recited in claim 3, wherein said hard alloy comprises 3–30% by weight of said binder metal phase.

8. A hard alloy as recited in claim 3, wherein said hard alloy comprises 0.1–30% by weight of said at least one compound selected from the group consisting of carbide, nitride and carbonitride.

9. A hard alloy as recited in claim 1, wherein said compressive stress remaining in said binder metal phase is no less than 15 $kgf/mm^2$.

10. A hard alloy as recited in claim 1, wherein said compressive stress remaining in said binder metal phase is no less than 20 $kgf/mm^2$.

11. A hard alloy as recited in claim 1, wherein said compressive stress remaining in said binder metal phase is no less than 35 $kgf/mm^2$.

* * * * *